US005813639A

United States Patent [19]

Hellwig et al.

[11] Patent Number: 5,813,639

[45] Date of Patent: Sep. 29, 1998

[54] WORK SURFACE END GABLE

[75] Inventors: John Hellwig, Toronto; Steve Verbeek, Aurora; Genadij Makarewicz, Brampton, all of Canada

[73] Assignee: Teknion Furniture Systems ( A Partnership of Teknion Holdings, Inc, and Birchgrove Investment Inc.), Downswren, Canada

[21] Appl. No.: 844,069

[22] Filed: Apr. 28, 1997

[51] Int. Cl.[6] ..... F16M 11/26

[52] U.S. Cl. ..... 248/188.5; 248/188; 248/188.1

[58] Field of Search ..... 248/188, 188.2, 248/188.5; 108/107, 147.19, 147.21; 403/3, 4, 109

[56] References Cited

U.S. PATENT DOCUMENTS

| | | | |
|---|---|---|---|
| 2,913,207 | 11/1959 | Eash | 248/148 |
| 3,061,392 | 10/1962 | Cooper | 248/188 |
| 3,210,035 | 10/1965 | Vincens | 248/188 |
| 3,977,801 | 8/1976 | Murphy | 248/188 |

*Primary Examiner*—Leslie A. Braun
*Assistant Examiner*—Robert Lipcsik

[57] ABSTRACT

The end gable includes a gable base and a gable extension securable to the gable base in one of a plurality of positions. The end gable is reversible to act as both a right and left end gable. The gable base is of a thin profile and is reinforced adjacent the base thereof with the gable extension reinforcing the upper portion of the end gable.

3 Claims, 3 Drawing Sheets

WORK SURFACE END GABLE

FIELD OF THE INVENTION

The present invention relates to an end gable for a work surface and in particular, relates to an end gable which is height adjustable.

BACKGROUND OF THE INVENTION

In systems for defining office work stations, it is desirable to have freestanding tables and desks which are height adjustable to customize the work station for a particular user or a particular application. There are now many examples of tables and desks which are height-adjustable by means of telescopic legs which can be manually adjusted or hydraulically adjusted to vary the work surface height. In office panelling systems, the associated work surfaces are either supported from the panelling system or in some cases, are self-supporting and merely associated with the panelling system. It is also recognized that in some circumstances it is desirable to have an end gable, as compared to a leg structure, to provide privacy and a different look.

Office panelling systems and office desking systems try to minimize the number of individual components while satisfying all the particular functions of the system. There is also a general trend in business to provide more workers with a customized office space or work station which has inherent flexibility to meet changing needs.

The present invention provides a simple end gable structure which allows for height adjustment. It is structurally robust and is cost effective to manufacture.

SUMMARY OF THE INVENTION

An end gable for supporting a work surface according to the present invention comprises a gable base and a gable extension where the gable extension is securable to the base in one of a plurality of work surface height positions. Each position defines a different support height for the work surface. The gable base at either end thereof has a column support which releasably engages a vertical extension member of the gable extension in one of the work surface height positions. The gable base includes a series of drop slots in each column support for receiving a lock pin secured to the respective vertical extension. In addition, the gable extension is secured by a mechanical fastening arrangement which in combination with a lock pin, positively locates the gable extension relative to the gable base.

According to an aspect of the present invention, the end gable is symmetrical about a vertical axis and as such, can be used for either a right or left hand end gable.

According to a further aspect of the invention, the vertical extension members of the end gable extension are received in guide channels located inwardly of the vertical column supports of the gable base.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
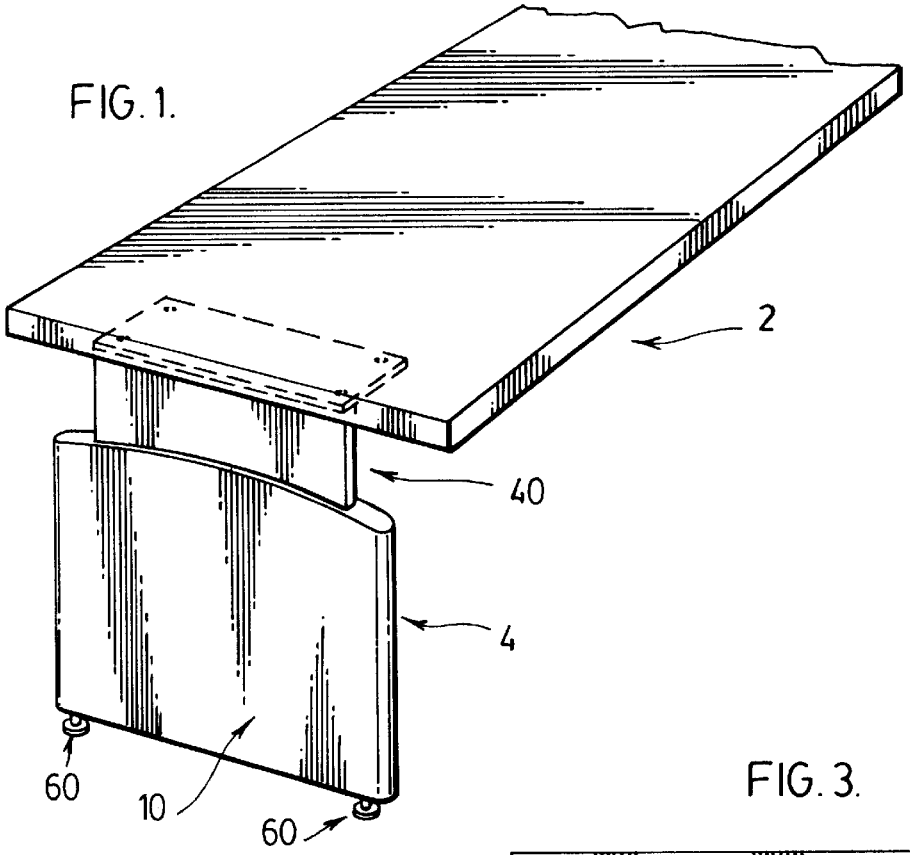
FIG. 1 is a partial perspective view showing a work surface supported at one end by an end gable.
Figure 2:
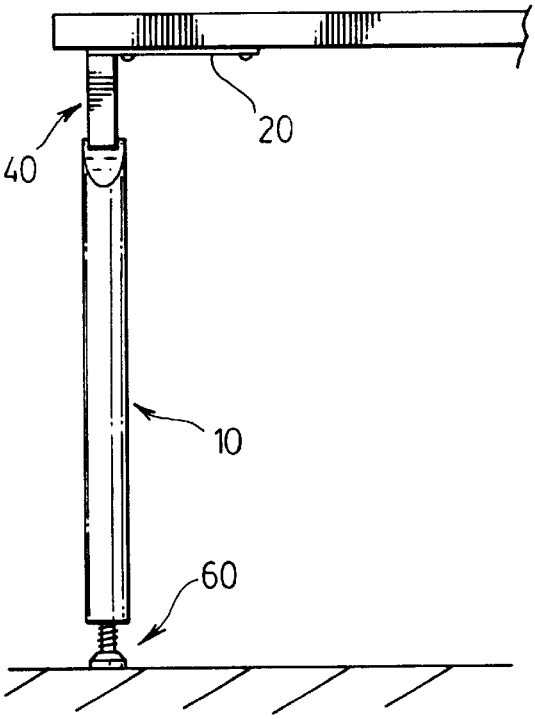
FIG. 2 is a side view work surface and support end gable in a first position.
Figure 3:
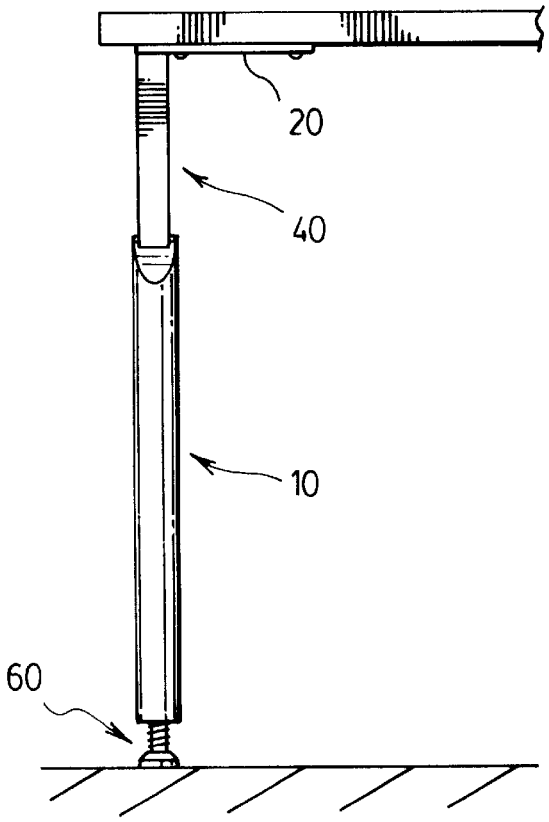
FIG. 3 is a view similar to FIG. 2 with the end gable adjusted to support a work surface at a higher position.

The work surface 2 is shown supported by the end gable 4 which has a gable base 10 with an associated gable extension 40. The gable extension 40 can be secured to the gable base in any of a series of different positions. Each of these positions defines a different work surface support height. Two such different work surface heights are shown in FIGS. 2 and 3. It can be seen from FIG. 1, that the end gable 4 is symmetrical about a vertical axis and as such, can be used either as a right or left end gable, merely by rotating the end gable 180 degrees. The end gable has screw levelling guides 60 at the base thereof.

Figure 4:
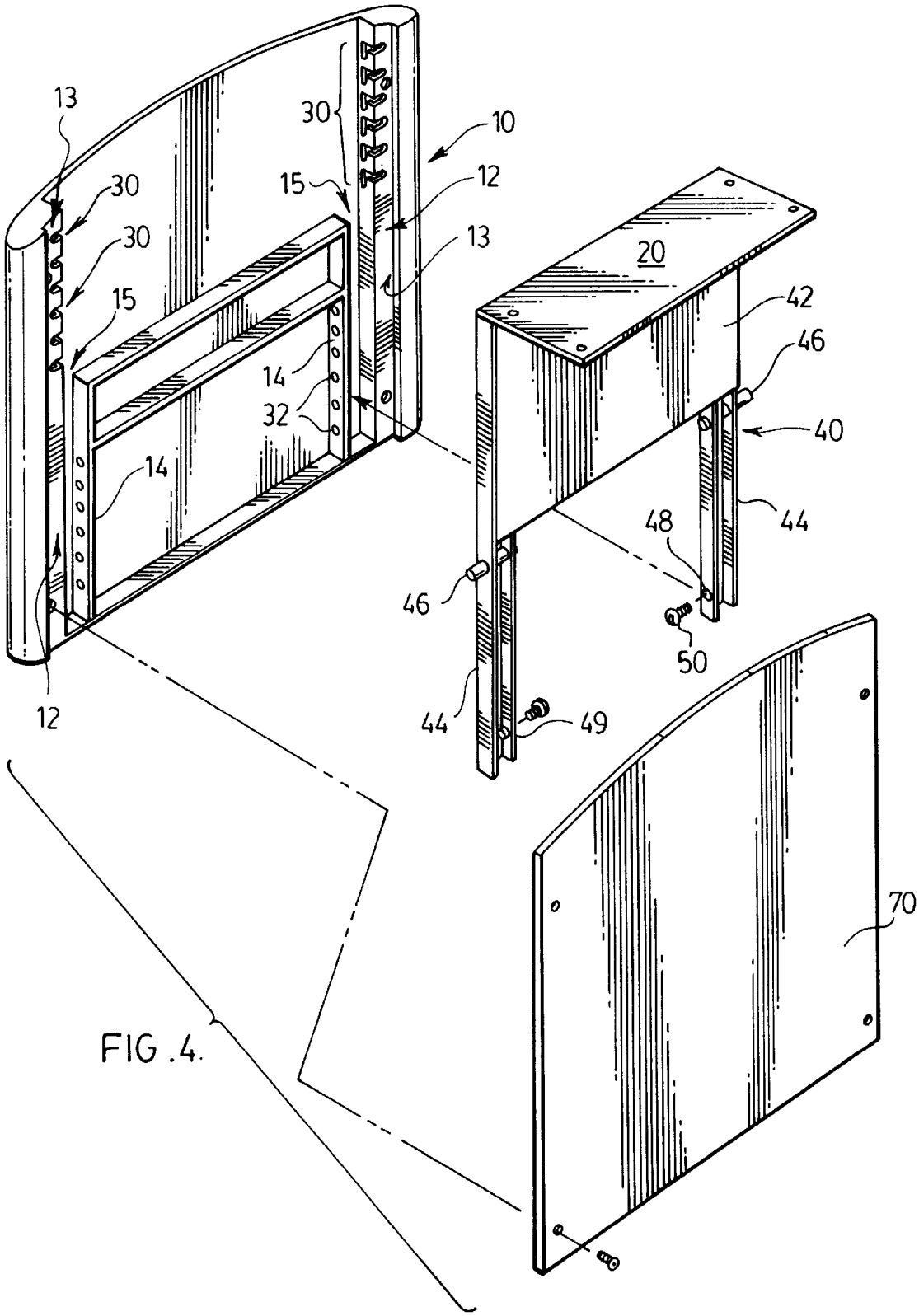
FIG. 4 is an exploded perspective view showing the end gable ba and the end gable extension.
Figure 5:
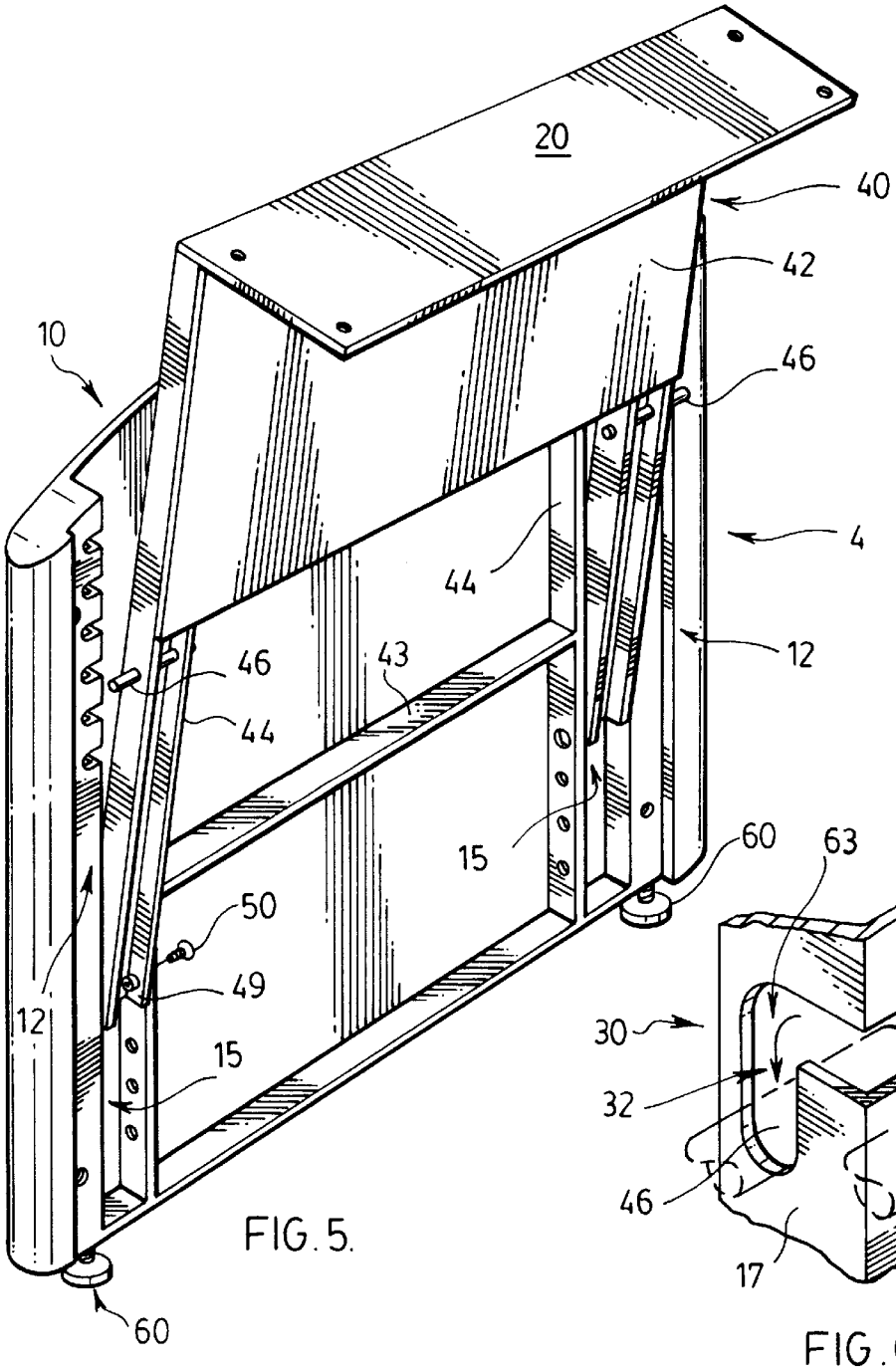
FIG. 5 illustrates height adjustment of an end gable.
Figure 6:
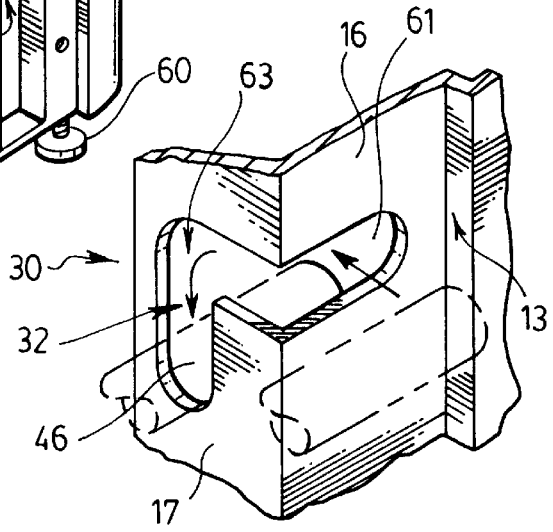
FIG. 6 is a partial perspective view showing a drop slot in a vertical column member of the end gable.

FIGS. 4, 5 and 6 illustrate how the gable extension 40 is secured to the gable base 10. The gable base includes end columns 12 on either side of the base with a series of opposed drop slots 30 in an upper portion of the end columns 12. These drop slots, as shown in FIG. 6, are generally L-shaped and are designed to receive a locking pin 46 associated with the gable extension by initially receiving the lock pin in the generally horizontal slot 61 in face 16 of FIG. 6 and then moving the pin to the vertically extending slot 63 in face 17. Once located in the bottom of slot 63, the lock pin is trapped and can only be removed by an upward movement of the extension, followed by a horizontal movement to cause it to pass out through slot 61. In effect, the lock pin 46, when located as shown in FIG. 6, is trapped initially by gravity and is basically locked in this position within the drop slot by means of the bolt 50, shown in FIG. 5.

The gable extension 40 has an upper panel 42 to provide a finished surface on the outside of the end gable as well as to the inside of the end gable. The particular position of the gable extension within the gable base determines the portion of the panel 42 that is exposed above the base.

The gable extension includes downwardly extending vertical members 44 which are received within guide channels 15, located inwardly of the end columns 12, and are partially defined by the end columns. Two guide channels 15 are shown in the base and these receive the vertical extension members 44 of the gable extension 40. The vertical members 44 include ports 48 and 49 at the lower end thereof, which are alignable with the ports 32 provided in the vertical stud 14 of the gable base. The ports 32 and the drop slots 30 are appropriately spaced such that the lower portion of the vertical members 44 can be locked in one of the ports 32 when the lock pins 46 are located in the bottom of a drop slot. The bolt 50 passes through the port 32 in the vertical stud 14 and the bolt can be maintained by a nut on the exposed end of the bolt 50 after it passes through the vertical members 44. With the bolt 50 in place, the gable extension 40 is locked to the gable base. Once so secured, the cover 70 can be secured to the interior of the gable base. Note that the cover is generally flushed with the end columns 12 due to the recess generally indicated as 13. Also note that the upper end of the cover 70 has a similar shape to the upper edge of the end gable.

It can be seen that the gable base has high strength due to the end columns 12 on either side of the gable base in combination with the guide channels 15 that are located inwardly of the end columns 12. The horizontal member 43 extending between the vertical studs 14, acts as a structural support and it can be appreciated that with the gable extension in place, the end gable is quite strong in the horizontal direction as horizontal member 43 provides positive reinforcement, essentially joining the end columns 12 via the vertical members 44 of the gable extension. The gable extension then cooperates with and reinforces the gable base.

The end gable as shown, has a thin profile (preferably about two inches) and an attractive look. This thin profile is achieved while still providing high structural strength with respect to the gable base.

The gable base, due to the end columns 12, are very strong at either end thereof and can easily support the adjustable glides indicated as 60. Note that these are positioned within the end columns 12 and as such, do not interfere with the channel-type securement between the gable base and the gable extension.

It can also be appreciated that the gable extension acts as a reinforcement adjacent to the upper edge of the gable base. There is a horizontal structural member joining the vertical 44 members generally at the lower edge of the visible panel 42.

In order to adjust the height of the gable extension relative to the gable base, the cover 70 is released from the gable base and the bolts 50 in the vertical members 44 are also released. At this time, the gable extension can be pulled upwardly to locate the lock pins 46 generally within the horizontal slots 61. If a work surface is already secured to the bracket 20 atop the gable extension 40, then the gable base can be angled outwardly to allow the lock pins 46 to pass through the slots 61. With this arrangement there is a tendency for the vertical members 44 to maintain their partial engagement within the guide channels 15. The user can appropriately move the gable extension to bring the lock pins 46 into registration with an appropriate drop slot. The gable base is then forced inwardly to align the lock pin with the slot 63. The gable extension is then lowered until the lock pin bottoms out in the drop slot. Once so located, the bolts 50 are secured adjacent the base of the gable extension to positively secure the vertical members 44 in the guide channels 15. Once this step is complete, the cover 70 is secured.

The present invention provides an end gable which can be manufactured in a cost effective manner and has high strength due to the cooperation between the gable extension and the gable base. The gable base is appropriately reinforced adjacent the lower portion of the base and the gable extension is reinforced to cooperate with the upper portion of the gable base to provide high strength at an upper level. The end gable is easily adjusted while providing positive securement of the gable extension within the gable base. Other methods for securing of the lower end of the vertical members to the gable base can be used. The gable is less than three inches in thickness. The mechanical fastening through a bolt and nut arrangement positively locks the structure and in particular, removes any play between the gable extension and the gable base.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An end gable for supporting a work surface comprising a gable base and a gable extension securable to said gable base at a plurality of work surface height positions where each position defines a different support height for the work surface, said gable base having opposed ends, each said end having a column support which is releasably engageable with a respective vertical extension member of said gable extension at any of said work surface height positions, and wherein said gable base has a series of drop slots in each column support for receiving a lock pin on the respective vertical extension member in addition to a mechanical securement arrangement for locking of said gable extension to said gable base in one of said work surface height positions.

2. An end gable as claimed in claim 1 wherein said end gable is symmetrical about a vertical axis.

3. An end gable as claimed in claim 1 wherein said vertical extension members of said gable extension are received in guide channels adjacent the column supports of said gable base.

* * * * *